United States Patent [19]

Anderson

[11] Patent Number: 4,987,996

[45] Date of Patent: Jan. 29, 1991

[54] FLEXIBLE DUCT AND CARTON

[75] Inventor: Charles B. Anderson, Jacksonville, Tex.

[73] Assignee: Atco Rubber Products, Inc., Fort Worth, Tex.

[21] Appl. No.: 493,939

[22] Filed: Mar. 15, 1990

[51] Int. Cl.[5] ..... B65D 85/14

[52] U.S. Cl. ..... 206/321; 206/446; 206/621; 206/815

[58] Field of Search ..... 206/321, 446, 607, 621, 206/626, 628, 815, 388, 802; 229/122, 131

[56] References Cited

U.S. PATENT DOCUMENTS

| | | | |
|---|---|---|---|
| 2,015,653 | 10/1935 | Andrews | 206/409 |
| 2,946,496 | 7/1960 | Stagmeier | 206/628 |
| 3,768,642 | 10/1973 | Hansen et al. | 206/321 |
| 3,891,137 | 6/1975 | Ellison et al. | 229/122 |
| 4,323,188 | 4/1982 | Dickerson | 206/815 |
| 4,771,884 | 9/1988 | Lamborn et al. | 206/321 |
| 4,773,538 | 9/1988 | Crawford | 229/122 |
| 4,921,105 | 5/1990 | Culbreth | 206/626 |

*Primary Examiner*—Jimmy G. Foster

*Attorney, Agent, or Firm*—Price, Heneveld, Cooper, DeWitt & Litton

[57] ABSTRACT

A flexible duct and carton for retaining and enabling controlled dispensing of the flexible duct positioned therein, the duct preferably being in a U-shaped orientation abutting end walls of the carton. The carton has a width about the diameter of the duct, and a breadth at least about twice the diameter of the duct. A breakout panel in a side wall adjacent one of the end walls forms a lateral outlet opening which has a width and a height greater than the duct diameter, whereby an end of the duct can be turned 90° and pulled out in controlled lengths.

4 Claims, 1 Drawing Sheet

FLEXIBLE DUCT AND CARTON

BACKGROUND OF THE INVENTION

This invention relates to the combination of flexible duct and a special carton cooperative with the duct to enable dispensing of controlled lengths of duct from the carton.

Flexible convoluted duct has the capacity to be extended or compressed to various lengths. Such duct typically is constructed of a helical support member as of metal or plastic, and an enclosure jacket which normally surrounds and/or embeds the helical support. When the duct is axially compressed, the helical support has inherent resilient bias tending to return the duct back to its original length. Such duct is typically shipped in compressed condition in a carton, as in a generally U-shaped configuration. Opening of the carton can result in the compressed duct springing forth not unlike a jack-in-the-box without attachment to the box.

One technique for controlling extension of the duct from the carton is that set forth in U.S. Pat. No. 4,771,884, i.e., providing a restricted opening in an end of the carton, smaller than the duct diameter, to require the duct to be physically pulled through this smaller opening while successive portions of the duct are transversely constricted. Applying these tensile and deformation stresses to the duct is not always desirable.

The inventor herein has conceived of a unique carton and duct arrangement to achieve controlled discharge of the duct from the carton without requiring the tensile stress and transverse deformation stress on the duct.

SUMMARY OF THE INVENTION

An object of this invention, therefore, is to provide a novel, relatively inexpensive dispensing carton and flexible duct arrangement capable of controllably dispensing the duct without the necessity of passage of the duct through a restricted opening. Thus, the duct need not be subjected to significant tensile stresses nor to transverse constriction stresses. Still, only a controlled amount of the duct is dispensed from the carton as desired.

The novel container has a pair of smaller side walls of a width about the diameter of the duct, another pair of side walls, usually larger, and flaps on the side walls forming carton end walls. One smaller side wall has a breakout panel adjacent the end wall and defined by a pair of spaced parallel perforated edges where the smaller side wall joins the adjacent two side walls. The panel also has a score line at the base thereof for the panel to fold therearound. The flap for this side wall includes a finger grip opening for pulling the breakout panel to open position When the flexible duct is compressed into the carton, typically but not necessarily in U-shaped configuration, both ends abut against the end wall adjacent this breakout panel. One end of the duct can be turned 90° to orient it toward the outlet opening to enable a controlled amount of duct to be withdrawn through the opening. Yet the opening has a width and height at least about that of the duct diameter to avoid excessive tensile pulling stresses and constriction of the duct during passage through the opening.

When a controlled amount of the duct is dispensed, it can be cut off and the remainder simply tucked back into to the carton, followed by closing of the breakout panel by extending its attached flap beneath the flaps of the adjacent two side walls.

These and other objects, advantages and features of the invention will become apparent upon review of the following detailed specification in conjunction with the drawings.

DESCRIPTION OF THE PREFERRED EMBODIMENT

Referring now specifically to the drawings, the combination 10 includes carton 12 and flexible compressible duct 14.

Figure 3:
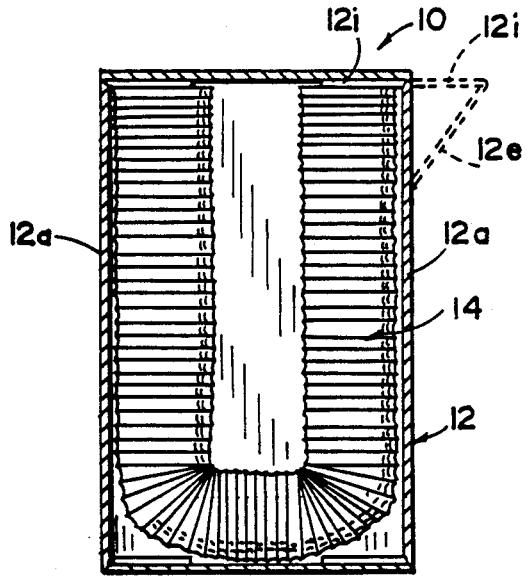
FIG. 3 is an elevational view of the combination in FIG. 2, showing the duct within the carton, the breakout panel being in a closed position, and the breakout panel and attached flap shown in phantom lines being moved to the open position.
Figure 2:
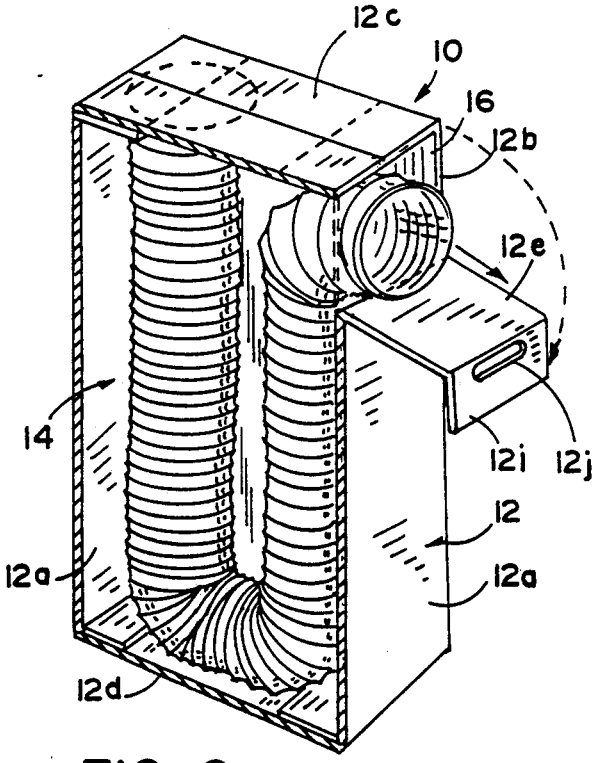
FIG. 2 is a perspective cutaway view of the carton and flexible duct combination, showing the breakout panel in the open position.

The duct 14 is composed of a helical support member having inherent resilient bias, made of metal or resilient plastic, in a helical configuration. Combined with this helical support member is a jacket as of plastic, e.g., polyvinylchloride or the like, typically surrounding and sometimes embedding the support member. Because of the inherent resilience and flexibility of the support member, the duct can be extended or compressed to various lengths, having an inherent biasing tendency to return to its original at-rest length. The wall portions of the jacket between the respective turns of the helical support member are highly flexible so as to fold upon each other as necessary when the structure is compressed. Such a flexible duct can also be flexed laterally from the axial orientation, e.g., to the preferred U-shaped configuration there depicted for placement in the carton, or into other configurations to conform to the installation in which the duct is to be placed. These factors of axial compressibility and configuration arrangements are also advantageous when handling and shipping the duct. That is, the duct can be placed in the compressed condition inside the carton to consume less space and enable ease of handling. It is typically placed in a generally U-shaped configuration in a carton, but can also be axially oriented. It will be appreciated that this U-shaped component can also be a series of U-shapes adjacent each other. Also, although a substantial space is shown between the legs of the single U in FIGS. 2 and 3 for illustrative purposes, this space may be very small in practice.

The carton 12 comprises a first pair of parallel spaced smaller side walls **12*a*, and another pair of usually larger parallel side walls which are normal to the first pair of side walls. All of these side walls are interconnected. This interconnection can be achieved from the blank 12*x* in FIG. 1 by folding the carton along the preformed crease marks or score lines 12' and overlapping the free edges or abutting them, securing them together with tape, adhesive or the like. Each of these four walls has end flaps. More specifically, each of these side walls has two end flaps, one on each end, whereby these flaps can be folded 90° over each other to collectively form a pair of end walls 12*c* and 12*d***. The flaps of the greater width side walls are preferably folded over the top of the flaps of the smaller width side walls after the latter are folded. Flaps of the wider side walls are then preferably taped together to maintain the end walls in closed condition.

The thickness of the carton, and thus the width of the smaller side walls 12*a*, is approximately that of the diameter of the duct or slightly greater. When the duct is shipped in a single U configuration, the width of the carton and thus the width of the larger side walls is slightly greater than twice the diameter of the duct. When a single U is formed, both free ends of the duct abut the same end wall in the manner depicted in FIG. 3. When the duct is in simple axial orientation, the opposite ends of the duct will abut opposite ends of the carton. Such a duct is considerably compressed axially in this packed condition such that, by closure of the flaps to form the end walls, there is resilient bias against the end walls by the duct.

In one of the smaller side walls is a breakout panel 12*e*. This breakout panel is defined in the carton blank adjacent one end of the wall in which it is formed. The side edges 12*f* of the breakout panel are spaced an amount equal to the width of that particular side wall, i.e., the depth of the carton, each side edge having a series of perforations along each of the two parallel side edges. Thus, the distance between these perforated lines is at least about equal to the diameter of the duct and preferably slightly larger. The base line of the breakout panel comprises a score line 12*g* transverse and preferably normal to perforated lines 12*f* and parallel to the bend or score line 12*h* between this breakout panel and the end flap 12*i* integrally attached thereto. This flap 12*i* also includes a finger grip means, preferably an oval type opening shown in phantom lines in FIG. 1 at 12*j*.

Figure 1:
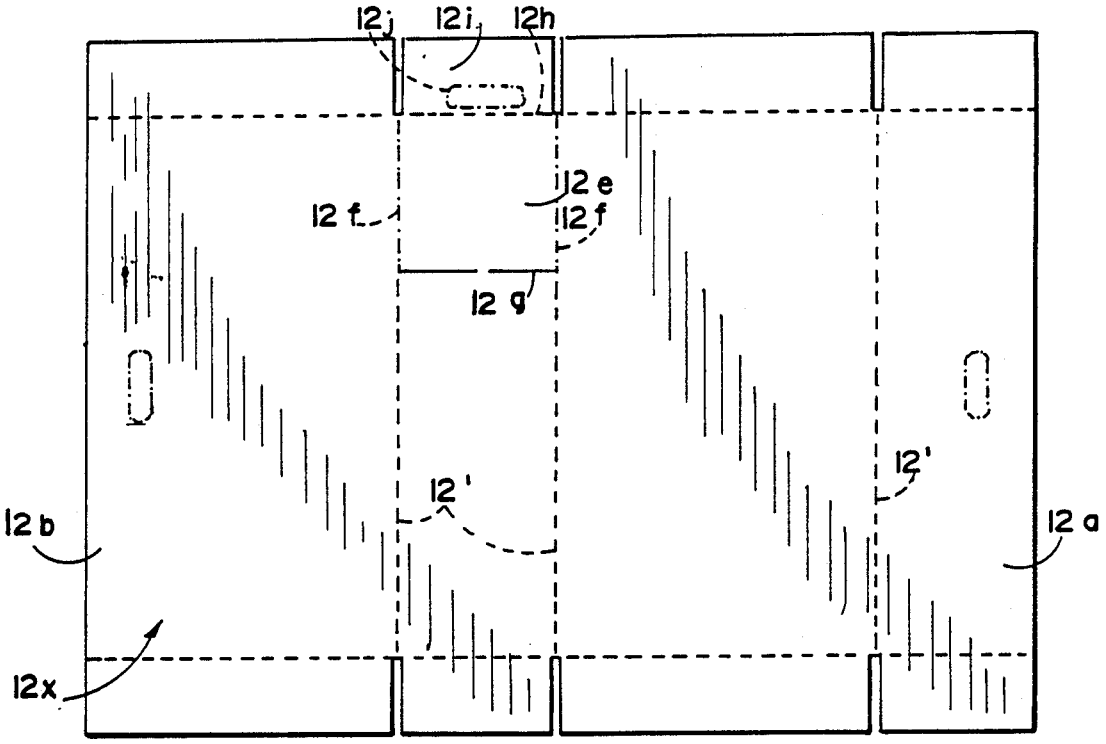
FIG. 1 is an elevational view of the carton blank.

In use, carton 12 is converted from its planar blank condition depicted in FIG. 1 by folding it along the crease lines 12' and securing the free opposite edges of one smaller wall 12*a* and one larger wall 12*b*. The flaps on one end of the carton are closed and secured to form one closed end wall 12*d*. The duct is then compressed and forced into the carton, preferably in a U-shaped configuration, after which the flaps on the opposite end of the carton are folded over each other and secured to form a second closed end wall 12*c*.

The unit is then ready for shipment and/or storage as necessary. To use the duct, a workman forces his fingers beneath the flaps of the wider walls under which flap 12*i* of the breakaway panel is tucked. The fingers are forced in sufficiently to get a grip on opening 12*j*, enabling the flap and panel to be pulled out away from the box as depicted partially in FIG. 3 and completely in FIG. 2, tearing the carton along perforations 12*f* and folding it about the crease line 12*g*, resulting in a discharge outlet 16. The adjacent free end of the duct is then flexed sideways 90° to be oriented toward this outlet opening. The resilient bias of the duct forces the turned duct portion against the end wall to prevent premature discharge of the duct from the container.

When it is desired to remove a predetermined length of flexible duct from the carton, the free end oriented toward opening 16 is grasped and pulled until a sufficient length extends from the carton. The compressed condition of the duct portion remaining in the carton will keep it from further discharge. This selected amount is then cut off the duct, the remaining portion is tucked back into the carton, and the breakout panel can be closed by folding it back to its original position, causing flap 12*i* to be tucked beneath the adjacent flaps of the wider side walls.

It is conceivable that certain variations on this construction of the preferred embodiment may be made within the concept presented. The invention is intended to be limited only by the scope of the appended claims and the reasonably equivalent structures to those defined therein.

The embodiments of the invention in which an exclusive property or privilege is claimed are defined as follows:

1. In combination, flexible duct and a carton for retaining and controllably dispensing said flexible duct therefrom, said carton comprising:

four connected side walls and two end walls;

said side walls comprising a first set of two walls parallel and opposite each other and a second set of two walls parallel and opposite each other and normal to said walls of said first set;

said end walls each being joined to said side walls thereby said side walls and said end walls enclose said carton;

said second set of walls each having a width about equal to the diameter of said flexible duct;

one of said side walls having a breakout panel to form an outlet area, defined by a pair of perforated lines;

said panel extending from the juncture of said one side wall with one of said end walls to a boundary in said one side wall spaced from said juncture an amount at least equal to the diameter of said duct, and said panel extending from the juncture of said one side wall with an adjacent side wall to the juncture of said one side wall and with the other adjacent side wall, said junctures with said one side wall and said adjacent side wall having said perforated lines;

said juncture of said one side wall with said one end wall comprising a folded flap of said one side wall tucked into said one end wall;

said duct being compressed in said carton, with at least one end thereof at said one end wall adjacent said panel, whereby with breakout of said panel to form an outlet by untucking said flap and causing breakage along said pair of perforated lines and bending at said boundary, said one end of said duct can be flexed 90° to be oriented toward said outlet while resiliently biased against said one end wall so that said duct is retained by said bias against premature passage through said outlet, but is capable of controlled passage therethrough by pulling on said one duct end.

2. In combination, flexible duct and a carton for retaining and controllably dispensing said flexible duct therefrom, said carton comprising:

four connected side walls and two end walls;

said side walls comprising a first set of two walls parallel and opposite each other and a second set of two walls parallel and opposite each other and normal to said walls of said first set;

said end walls each being joined to said side walls thereby said side walls and said end walls enclose said carton;

said end walls being formed of folded side wall flaps;

said second set of walls each having a width about equal to the diameter of said flexible duct;

one of said side walls of said second set having a breakout panel to form an outlet area, defined by perforated lines;

said panel extending from the juncture of said one side wall with one of said end walls to a boundary in said one side wall spaced from said juncture an amount at least equal to the diameter of said duct, and said panel extending from the juncture of said one side wall with an adjacent side wall to the juncture of said one side wall and with the other adjacent side wall and joined to one of said side wall flaps, said junctures with said one side wall and said adjacent side wall including a pair of parallel perforated lines;

said one side wall flap having finger gripping means for enabling fingers to grip said one side wall flap and pull said flap and said panel for breakout of said panel along said perforated lines;

said duct being compressed in said carton, with at least one end thereof at said one end wall adjacent said panel, whereby with breakout of said panel to form an outlet, said one end of said duct can be flexed 90° to be oriented toward said outlet while resiliently biased against said one end wall so that said duct is retained by said bias against premature passage through said outlet, but is capable of controlled passage therethrough by pulling on said one duct end.

3. The combination in claim 2 wherein said panel boundary comprises a score line to enable said panel to bend thereabout for duct dispensing, and bend back for panel closure.

4. The combination in claim 2 wherein said one flap is tucked beneath adjacent flaps when closed.

* * * * *